US011103975B2

(12) United States Patent
Kim

(10) Patent No.: US 11,103,975 B2
(45) Date of Patent: Aug. 31, 2021

(54) ABRASIVE DISK HAVING EXCELLENT WORKABILITY AND STABILITY AND PROCESS FOR PRODUCING THE SAME

(71) Applicant: TU GLOBAL LTD., Pyeongtaek-si (KR)

(72) Inventor: Yong Bum Kim, Yongin-si (KR)

(73) Assignee: TU GLOBAL LTD., Pyeongtaek-si (KR)

( * ) Notice: Subject to any disclaimer, the term of this patent is extended or adjusted under 35 U.S.C. 154(b) by 166 days.

(21) Appl. No.: 16/360,659

(22) Filed: Mar. 21, 2019

(65) Prior Publication Data

US 2019/0291243 A1 Sep. 26, 2019

(30) Foreign Application Priority Data

Mar. 22, 2018 (KR) ..... 10-2018-0033218

(51) Int. Cl.

| | |
|---|---|
| ***B24D 7/14*** | (2006.01) |
| ***B24D 3/28*** | (2006.01) |
| ***B24D 7/04*** | (2006.01) |
| ***B24D 18/00*** | (2006.01) |
| ***B24D 11/02*** | (2006.01) |
| *B24D 3/00* | (2006.01) |

(52) U.S. Cl.

CPC ..... *B24D 7/14* (2013.01); *B24D 3/28* (2013.01); *B24D 7/04* (2013.01); *B24D 11/02* (2013.01); *B24D 18/0009* (2013.01); *B24D 18/0027* (2013.01); *B24D 3/002* (2013.01)

(58) Field of Classification Search

CPC . B24D 3/002; B24D 3/28; B24D 7/04; B24D 7/14; B24D 11/02; B24D 18/0009; B24D 18/0027

See application file for complete search history.

(56) References Cited

U.S. PATENT DOCUMENTS 2,233,175 A * 2/1941 Melton ..... B24D 11/005 51/298
2,320,139 A * 5/1943 Kirchner ..... B24D 13/14 451/533
4,082,521 A * 4/1978 McGarvey ..... B24D 11/06 51/295

(Continued)

FOREIGN PATENT DOCUMENTS

CN 103111959 A * 5/2013
EP 1 884 316 A1 2/2008

(Continued)

OTHER PUBLICATIONS

Korean Office Action of 10-2018-0033218 dated Jul. 23, 2018.

*Primary Examiner* — Pegah Parvini
*Assistant Examiner* — Ross J Christie
(74) *Attorney, Agent, or Firm* — Sughrue Mion, PLLC

(57) ABSTRACT

The present invention relates to an abrasive disk that is excellent in workability and stability and has a low degree of fatigue applied to workers and tools, and a process for producing the same. The abrasive disc is excellent in stability by virtue of a high adhesive strength of each layer, has high flexibility, elasticity, and adhesiveness, and is lightweight per unit area. Thus, it has a low degree of fatigue applied to workers and expensive tools. In addition, according to the above production process, the abrasive disk can be continuously mass-produced.

18 Claims, 2 Drawing Sheets

(56) References Cited

U.S. PATENT DOCUMENTS

| | | | | |
|---|---|---|---|---|
| 6,066,188 | A * | 5/2000 | Benedict | B24D 3/20 51/295 |
| 6,197,076 | B1 * | 3/2001 | Braunschweig | B24D 3/002 451/538 |
| 7,329,455 | B2 | 2/2008 | Brown | |
| 9,156,134 | B2 | 10/2015 | Kim | |
| 9,751,192 | B2 * | 9/2017 | Sharmila | B24D 18/0027 |
| 9,873,183 | B2 * | 1/2018 | Ri | B24D 18/0072 |
| 2002/0026752 | A1 | 3/2002 | Culler et al. | |
| 2005/0120636 | A1 | 6/2005 | Kim | |
| 2009/0205259 | A1 * | 8/2009 | Burzynski | C09K 3/1409 51/295 |
| 2015/0174736 | A1 * | 6/2015 | Sathyanarayanaiah | B32B 5/024 51/298 |

FOREIGN PATENT DOCUMENTS

| | | | |
|---|---|---|---|
| KR | 10-0469222 | B1 | 1/2005 |
| KR | 2006-0134024 | A | 12/2006 |
| KR | 2007-0031982 | A | 3/2007 |
| KR | 2009-0012293 | A | 2/2009 |
| KR | 2018-0008122 | A | 1/2018 |
| WO | 95/22434 | A1 | 8/1995 |
| WO | 2008/105639 | A1 | 9/2008 |

* cited by examiner

[Fig. 1]
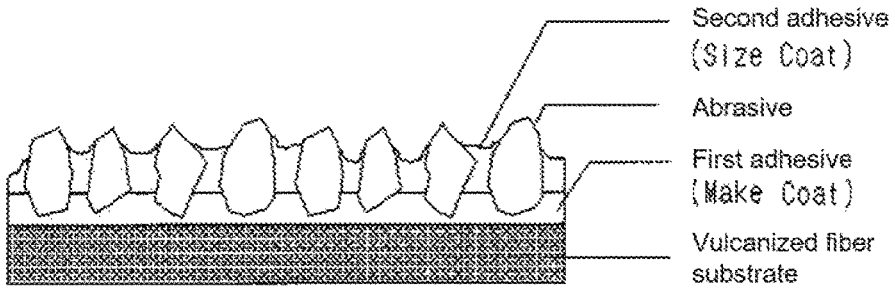
[Fig. 2]
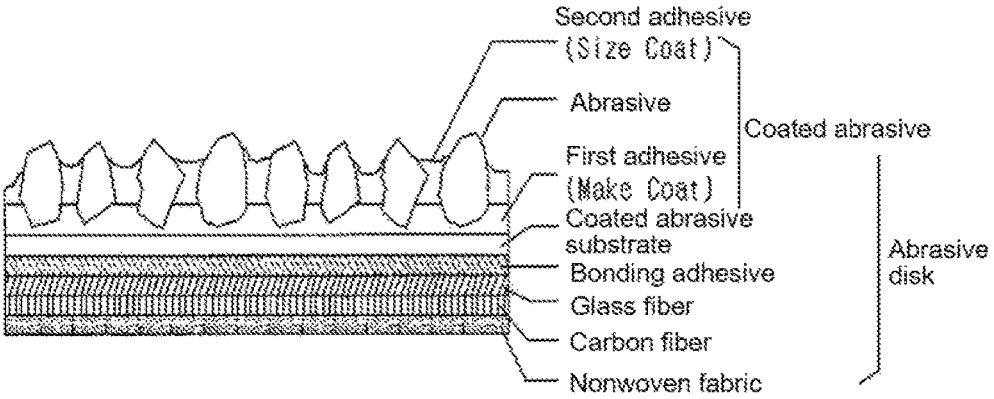
[Fig. 3]
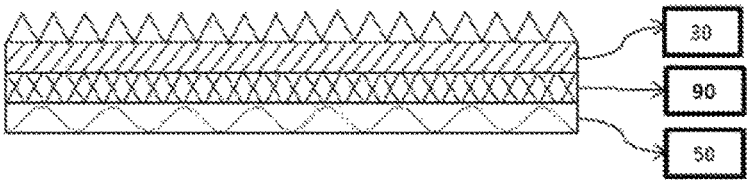
[Fig. 4]
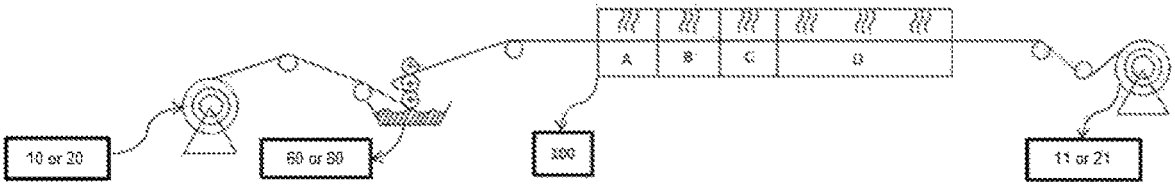
[Fig. 5]

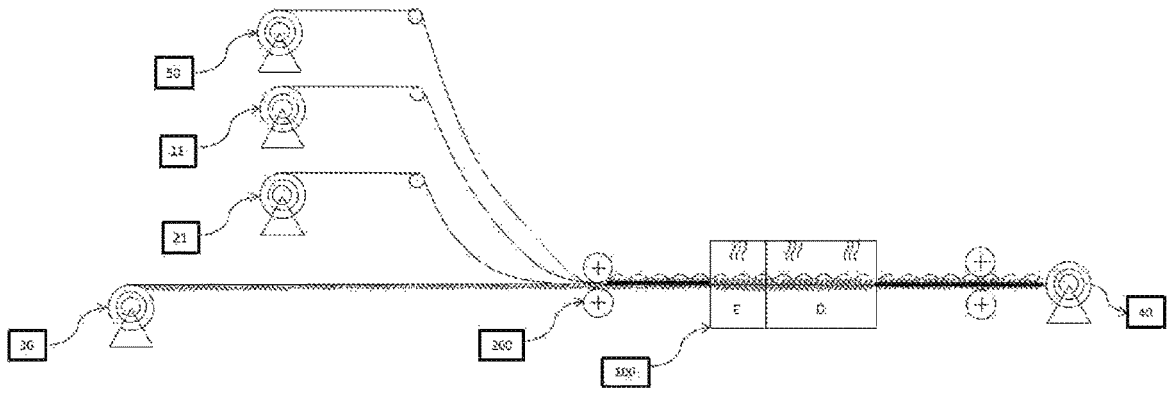
[Fig. 6]
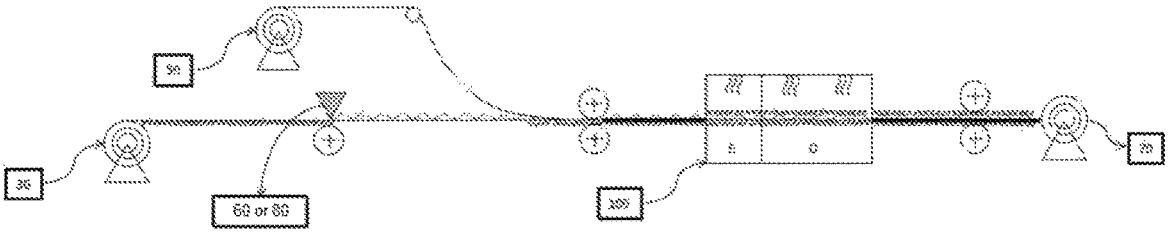
[Fig. 7]
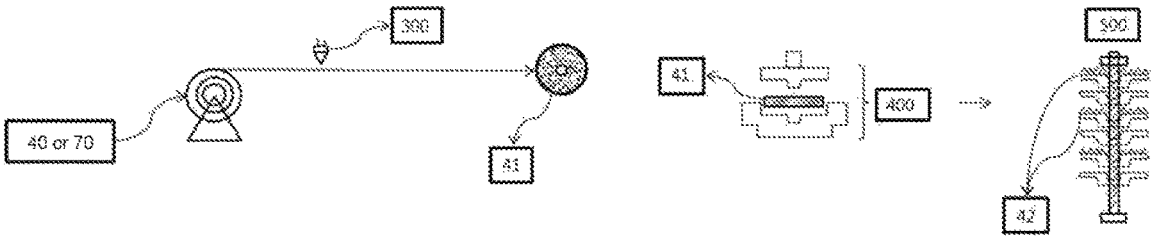

ABRASIVE DISK HAVING EXCELLENT WORKABILITY AND STABILITY AND PROCESS FOR PRODUCING THE SAME

TECHNICAL FIELD

The present invention relates to an abrasive disk that is excellent in workability and stability and has a low degree of fatigue applied to workers and tools, and a process for producing the same. The abrasive disc is excellent in stability by virtue of a high adhesive strength of each layer, has high flexibility, elasticity, and adhesiveness, and is lightweight per unit area. Thus, it has a low degree of fatigue applied to workers and expensive tools. In addition, according to the production process, the abrasive disk can be continuously mass-produced.

BACKGROUND ART OF THE INVENTION

As shown in FIG. 1, a conventional abrasive disk that uses a vulcanized fiber as a substrate is produced by a process in which a thermosetting adhesive resin is applied on the vulcanized fiber to form a first adhesive layer, an abrasive is sprayed thereon and preliminarily dried, and a thermosetting adhesive resin is then applied thereon and dried to form a second adhesive layer.

In such event, moisture contained in the vulcanized fiber is entirely released by the heat in the drying step, so that the size of the abrasive disk may be deformed or the abrasive disk may be easily broken even by a small impact. Thus, there has been a disadvantage that it is inevitable to perform a humidification treatment step and an aging step to impart moisture to the abrasive disk in order to enhance the dimensional stability, bending prevention, and impact resistance.

As an alternative to the above process, as a process for producing an abrasive disk without a humidification treatment step, Korean Patent No. 10-0469222 discloses a technique in which an adhesive is applied on a back pad comprised of a nonwoven fabric and a fabric layer (e.g., a carbon fiber layer, a glass fiber layer, a composite fiber layer, or a laminate thereof), followed by bonding the substrate surface of a coated abrasive thereto and thermally pressing them (see FIG. 2).

Although the abrasive disc of the above-mentioned patent has excellent dimensional stability and rotational fracture strength, it has low flexibility, elasticity, and adhesiveness. Thus, there is a limitation that it can be used only for certain applications. There is also a problem that the productivity is low since the production is based on a batch process.

PRIOR ART DOCUMENT

Patent Document (Patent Document 1) Korean Patent No. 10-0469222

DISCLOSURE OF THE INVENTION

Technical Problem to be Solved

Accordingly, an object of the present invention is to provide an abrasive disk, which can be used for various applications by virtue of its high flexibility, elasticity, and adhesiveness, has a low degree of fatigue applied to workers and expensive tools since it is lightweight, and is excellent in stability since it has a high adhesive force between the layers.

In addition, another object of the present invention is to provide a process for continuously mass-producing the above abrasive disk.

Solution to the Problem

In order to achieve the above object, the present invention provides an abrasive disk, which comprises:

a coated abrasive;

an interposed layer comprising at least one selected from the group consisting of a hemp fabric layer, a glass fiber fabric layer, and an adhesive layer; and a vulcanized fiber layer.

In addition, the present invention provides a process for producing an abrasive disk, which comprises:

(1) laminating a coated abrasive, an interposed material, and a vulcanized fiber, and then pressing, drying, and winding the laminate to prepare a roll-shaped laminate; and (2) unwinding the roll-shaped laminate and cutting it into a predetermined shape to continuously produce a plurality of abrasive discs, wherein the interposed material comprises at least one selected from the group consisting of a hemp fabric, a glass fiber fabric, and an adhesive, and the lamination, pressing, drying, and winding in the above step (1) are carried out in a continuous process.

Advantageous Effects of the Invention

The abrasive disk according to the present invention is excellent in adhesiveness, flexibility, and elasticity, has a low degree of fatigue applied to workers and tools since it is lightweight per unit area, and is excellent in stability by virtue of the high adhesive force of each layer.

In addition, the production process according to the present invention is capable of mass-producing the abrasive disk in a continuous process.

BRIEF DESCRIPTION OF THE DRAWINGS

FIGS. 1 and 2 are cross-sectional views of a conventional abrasive disk.

FIG. 3 is a cross-sectional view of an abrasive disk according to an embodiment of the present invention.

FIG. 4 is a schematic view of a process for treating the surface of a glass fiber fabric or hemp fabric according to an embodiment of the present invention.

FIGS. 5 and 6 are schematic views of a process for producing a roll-shaped laminate according to an embodiment of the present invention.

FIG. 7 is a schematic view of a process for cutting a roll-shaped laminate and shaping it according to an embodiment of the present invention.

DETAILED DESCRIPTION FOR CARRYING OUT THE INVENTION

The present invention provides an abrasive disk, which comprises a coated abrasive; an interposed layer comprising at least one selected from the group consisting of a hemp fabric layer, a glass fiber fabric layer, and an adhesive layer; and a vulcanized fiber layer.

Coated Abrasive

The coated abrasive may comprise an abrasive layer that comprises a coated abrasive substrate and an abrasive. Specifically, the coated abrasive may be comprised of an abrasive layer that comprises a coated abrasive substrate and an abrasive.

The coated abrasive substrate may be a cotton fabric, a polyester fabric, a rayon fabric, a cotton/polyester blended fabric, a polyester film (e.g., PET film), or paper.

The abrasive may comprise at least one selected from the group consisting of alumina ($Al_2O_3$), silicon carbide (SiC), a mixture of alumina and zirconia, ceramic (produced by the sol-gel method), and diamond. In addition, the average particle diameter of the abrasive may be 15 to 3,000 μm, 15 to 1,250 μm, or 90 to 1,250 μm.

The coated abrasive may have an average thickness of 0.15 to 4.00 mm. Specifically, the coated abrasive may have an average thickness of 1.0 to 3.5 mm, 2.9 to 3.5 mm, 2.0 to 2.5 mm, 1.5 to 2.0 mm, or 1.0 to 1.5 mm.

Hemp Fabric Layer

The hemp fabric layer may be impregnated with a thermosetting resin or a thermoplastic resin. Specifically, the hemp fabric layer may be impregnated with a thermosetting resin or thermoplastic resin in an amount of 100 to 900 g/m$^2$, 100 to 600 g/m$^2$, or 250 to 400 g/m$^2$, and then dried at 90 to 165° C. More specifically, the hemp fabric layer may be impregnated with a thermosetting resin.

The thermosetting resin may be at least one selected from the group consisting of a phenol resin, a polyester resin, an epoxy resin, a urea resin, a melamine resin, a diallyl phthalate prepolymer resin, a furan resin, an alkyd resin, an unsaturated polyester resin, a silicone resin, and a polyurethane resin. Specifically, the thermosetting resin may be a phenol resin, an epoxy resin, a urea resin, a melamine resin, or a polyurethane resin.

The thermoplastic resin may be at least one selected from the group consisting of a vinyl chloride resin, a vinylidene chloride resin, a vinyl acetate resin, polyvinyl alcohol, polyvinyl acetal, polystyrene, a styrene-acrylonitrile resin (AS resin), an acrylonitrile butadiene styrene resin (ABS resin), a methacrylic resin, polyethylene, polypropylene, a fluororesin, polyamide, polyacetal, polycarbonate, polyvinylene oxide, polysulfone, celluloid, a cellulose acetate resin, a vinylene acetate resin, and a saturated polyester. Specifically, the thermoplastic resin may comprise a vinyl acetate resin, a mixed resin of a vinyl acetate resin and polyvinyl alcohol, a vinyl chloride resin, a vinylene acetate resin, or polystyrene.

The thermosetting resin or the thermoplastic resin may have a viscosity (IV) of 800 to 1,500 cps at 25° C. Specifically, the thermosetting resin or the thermoplastic resin may have a viscosity (IV) of 900 to 1,200 cps at 25° C.

The weight average molecular weight of the thermosetting resin may be 10,000 to 20,000 g/mole. Specifically, the weight average molecular weight of the thermosetting resin may be 12,000 to 15,000 g/mole.

The weight average molecular weight of the thermoplastic resin may be 900 to 50,000 g/mole. Specifically, the weight average molecular weight of the thermoplastic resin may be 900 to 20,000 g/mole or 900 to 12,000 g/mole.

The hemp fabric layer may have a fiber thickness of 4 to 16 s and 5×5 to 13×13 (warp×weft) tex/yarn, a weight per unit area of 105 to 485 g/m$^2$, a texture of 5×6 to 13×14 (warp×weft) counts/inch, and a thickness of 0.5 to 3.5 mm. Specifically, the hemp fabric layer may have a fiber thickness of 4 to 13 s, 6 to 10 s, or 6 to 8 s and 5×5, 6×6, 8×8, or 10×10 to 10×12 (warp×weft) tex/yarn, a texture of 5×6, 8×8, 10×10, or 13×14 (warp×weft) counts/inch, and a thickness of 0.85 to 1.25 mm.

The hemp fabric layer may comprise at least one selected from the group consisting of flex, ramie (ramie cloth), hemp (hemp cloth), jute, manila hemp, sisal hemp, New Zealand hemp, aloe fiber, and coconut fiber. Specifically, the hemp fabric layer may comprise jute. If the hemp fabric layer comprises jute, an abrasive disk having excellent abrasive performance can be produced more economically.

In addition, the hemp fabric layer may have a mesh-like structure.

Glass Fiber Fabric Layer

The glass fiber fabric layer may be impregnated with a thermosetting resin or a thermoplastic resin. Specifically, the glass fiber fabric layer may be impregnated with a thermosetting resin or a thermoplastic resin in an amount of 100 to 1,200 g/m$^2$, 100 to 600 g/m$^2$, or 600 to 1,200 g/m$^2$, and then dried at 90 to 165° C. More specifically, the glass fiber fabric layer may be impregnated with a thermosetting resin.

The glass fiber fabric layer may have a structure of a plain fabric, a satin fabric, a twill fabric, or a leno fabric. In addition, the glass fiber fabric layer may have a texture of 3 to 20×3 to 20 (warp×weft) counts/inch.

The glass fiber fabric layer may have a fiber thickness of G75 ¼ to H50 ⅔×G75 ¼ to H50 ⅔ (warp×weft) tex/yarn. Here, 6 refers to 8.89 to 10.15 μm, and H refers to 10.16 to 11.42 μm.

The glass fiber fabric layer may comprise at least one selected from the group consisting of E-GLASS, C-GLASS, AR-GLASS, S-GLASS, and D-GLASS. Specifically, the glass fiber fabric layer may comprise E-GLASS.

The glass fiber fabric layer may have a modulus of 60 to 90 GPa, a tensile strength of 2,500 to 4,000 MPa at 25° C., and a fiber density of 15 to 60 g/cm$^3$. Specifically, the glass fiber fabric layer may have a modulus of 65 to 80 GPa or 65 to 75 GPa, a tensile strength of 3,000 to 4,000 MPa or 3,000 to 3,500 MPa at 25° C., and a fiber density of 20 to 50 g/cm$^3$, 25 to 45 g/cm$^3$, or 25 to 40 g/cm$^3$.

The glass fiber fabric layer may have a weight per unit area of 10 to 500 g/m$^2$ and a thickness of 0.1 to 0.8 mm. Specifically, the glass fiber fabric layer may have a weight per unit area of 15 to 460 g/m$^2$ and a thickness of 0.1 to 0.7 mm.

The thermosetting resin or the thermoplastic resin may be appropriately selected from the same kinds as used in the impregnation treatment of the hemp fabric layer.

Adhesive Layer

The adhesive layer may comprise a thermosetting resin or a thermoplastic resin that has a weight average molecular weight of 900 to 50,000 g/mole. Specifically, the adhesive layer may comprise a thermosetting resin or a thermoplastic resin that has a weight average molecular weight of 900 to 20,000 g/mole or 900 to 12,000 g/mole. Specifically, the adhesive layer may comprise a thermosetting resin that has a weight average molecular weight of 900 to 50,000 g/mole, if the adhesive layer comprises a thermosetting resin, the physical properties of the abrasive disk can be further enhanced.

The thickness of the adhesive layer may be 0.5 to 3.0 mm. Specifically, the thickness of the adhesive layer may be 0.5 to 1.5 mm, 0.7 to 1.5 mm, or 0.85 to 1.00 mm.

Vulcanized Fiber Layer

The vulcanized fiber layer may comprise a fiber derived from a wooden fiber. Specifically, the vulcanized fiber layer may comprise a fiber prepared by treating a wooden fiber with a zinc chloride solution, a copper ammonia solution, or a sulfuric acid solution. More specifically, the vulcanized fiber layer may comprise a fiber prepared by treating a wooden fiber with a zinc chloride solution, a copper ammonia solution, or a sulfuric acid solution, and laminating a plurality of the surface treated wooden fibers, followed by pressing and drying them.

A wooden fiber has merits in that it is flexible since it has a smaller density than that of a cotton fiber, is excellent in electrical insulation, and is advantages in rolling workability. Thus, since a wooden fiber-based vulcanized fiber is advantageous in that it is readily wound in the form of a roll having a large width, an abrasive disk comprising the same is excellent in flexibility and adhesiveness, less influenced by external humidity; and excellent in heat resistance.

The vulcanized fiber may have a fiber density of 0.5 to 1.25 g/cm$^3$; a tensile strength of 2,000 to 5,000 N/cm$^2$ at 25° C.; an adhesive strength between layers of 1,100 to 2,000 N/cm$^2$ at 25° C.

The vulcanized fiber layer may have an average thickness of 0.085 to 1.25 mm and a weight per unit area of 100 to 2,000 g/m$^2$. Specifically, the vulcanized fiber layer may have an average thickness of 0.1 to 1.0 mm, 0.4 to 0.8 mm, 0.4 to 0.6 inns, or 0.45 to 0.55 mm, and a weight per unit area of 100 to 630 g/m$^2$ or 800 to 1,300 g/m$^2$.

The vulcanized fiber layer has a moisture content of 6.0 to 8.0%, a breaking load of 580 N/15 mm or more, and a tensile strength of 2,000 to 5,000 N/cm$^2$ at 25° C. Specifically, the vulcanized fiber layer has a moisture content of 6.0 to 7.5%, a breaking load of 720 N/15 mm or more, and a tensile strength of 2,000 to 4,500 N/cm$^2$ or 3,000 to 4,400 N/cm$^2$ at 25° C. More specifically, the vulcanized fiber layer has a moisture content of 6.5 to 7.5%, a breaking load of 720 to 1,000 N/15 mm, and a tensile strength of 3,500 to 4,400 N/cm$^2$ or 3,800 to 4,200 N/cm$^2$ at 25° C.

Structure of the Abrasive Disk

The abrasive disk may have a planar shape or a curved shape as a whole.

In the case where the abrasive disk has a curved shape as a whole, it may have a structure in which a vulcanized fiber layer, an interposed layer, and a coated abrasive are sequentially laminated from the convex surface of the curved surface. Specifically, the abrasive disk may have a structure in which a vulcanized fiber layer, a glass fiber fabric layer, and a coated abrasive that are sequentially laminated; a structure in which a vulcanized fiber layer, a glass fiber fabric layer, a hemp fabric layer, and a coated abrasive are sequentially laminated; or a structure in which a vulcanized fiber layer, an adhesive layer, and a coated abrasive are sequentially laminated from the convex surface of the curved surface.

In the case where the abrasive disk has a curved shape as a whole, the connecting line between the edge of the abrasive disk and the center of the inner concave surface, when the abrasive disk is placed upside-down on the ground, may form an angle of 5 to 9 degrees with the ground surface (see FIG. 3).

In the case where the abrasive disk has a planar shape as a whole, the abrasive disk may comprise a structure in which a vulcanized fiber layer, a glass fiber fabric layer, and a coated abrasive are sequentially laminated; a structure in which a vulcanized fiber layer, a glass fiber fabric layer, a hemp fabric layer, and a coated abrasive are sequentially laminated; or a structure in which a vulcanized fiber layer, an adhesive layer, and a coated abrasive are sequentially laminated.

In addition, the substrate surface of the coated abrasive and the interposed layer of the abrasive disc may be in contact so that the abrasive layer of the coated abrasive is exposed.

Further, the shape of the abrasive disk may be variously modified.

The abrasive disk may have a thickness of 0.75 to 3.00 mm. Specifically, the abrasive disk may have a thickness of 0.8 to 2 mm, 0.9 to 1.5 mm, or 0.95 to 1.25 mm.

Process for Producing an Abrasive Disk

The process for producing an abrasive disk according to the present invention comprises:

(1) laminating a coated abrasive, an interposed material, and a vulcanized fiber, and then pressing, drying, and winding the laminate to prepare a roll-shaped laminate; and (2) unwinding the roll-shaped laminate and cutting it into a predetermined shape to continuously produce a plurality of abrasive discs, wherein the interposed material comprises at least one selected from the group consisting of a hemp fabric, a glass fiber fabric, and an adhesive, and the lamination, pressing, drying, and winding in the above step (1) are carried out in a continuous process.

Step (1)

In this step, a coated abrasive, an interposed material, and a vulcanized fiber are laminated, and the laminate is then pressed, dried, and wound to prepare a roll-shaped laminate.

The lamination may be carried out by sequentially laminating a vulcanized fiber layer, a glass fiber fabric layer, and a coated abrasive; sequentially laminating a vulcanized fiber layer, a glass fiber fabric layer, a hemp fabric layer, and a coated abrasive; or sequentially laminating a vulcanized fiber layer, an adhesive layer, and a coated abrasive.

The hemp fabric and the glass fiber fabric layer each may be impregnated with a thermosetting resin or a thermoplastic resin and then dried at 90 to 165° C. Specifically, the hemp fabric and the glass fiber fabric layer each may be impregnated with a thermosetting resin or a thermoplastic resin and then dried at 90 to 165° C. for 5 to 30 minutes. Specifically, the drying may comprise first drying at 90 to 98° C. for 1 to 5 minutes; second drying at 100 to 110° C. for 5 to 10 minutes; third drying at 115 to 125° C. for 5 to 10 minutes; and fourth drying at 140 to 165° C. for 5 to 10 minutes. More specifically, the first drying to the fourth drying may be carried out in a continuous process.

The kind of the thermosetting resin or the thermoplastic resin and the amount of impregnation are as described above with respect to the abrasive disk.

In this step, the pressing may be carried out under a pressure of 10 to 100 bar at 80 to 165° C., and the drying may be carried out at 120 to 150° C. Specifically, the pressing may be carried out under a pressure of 10 to 50 bar at 100 to 150° C. for 1 to 6 hours, and the drying may be carried out at 125 to 145° C. for 15 to 460 minutes. More specifically, the drying may comprise a first drying carried out at 120 to 135° C. or 125 to 135° C. for 5 to 20 minutes; and a second drying carried out at 140 to 150° C. or 142 to 147° C. for 10 to 440 minutes.

Specifically, in this step, a coated abrasive, a hemp fabric, a glass fiber fabric, and a vulcanized fiber may be sequentially laminated. The laminate may then be pressed under a pressure of 10 to 50 bar at 90 to 160° C. and dried at 120 to 150° C. In addition, in this step, an adhesive may be applied on a coated abrasive, and a vulcanized fiber may be laminated thereon. The laminate may then be pressed under a pressure of 15 to 30 bar at 125 to 145° C. and dried at 120 to 150° C.

The adhesive may be a thermosetting resin or a thermoplastic resin. The kind of the thermosetting resin or the thermoplastic resin are as described above with respect to the abrasive disk.

The coating thickness of the adhesive may be 0.5 to 3.0 mm. Specifically, the coating thickness of the adhesive may be 0.5 to 1.5 mm, 0.7 to 1.5 mm, or 0.85 to 1.20 mm.

The winding may be carried out using a winder at a speed of 5 to 20 m/min. Specifically, the winding may be carried out using a winder at a speed of 10 to 20 m/min., 10 to 18 m/min, or 12 to 16 m/min.

In addition, the lamination, pressing, drying, and winding are carried out in a continuous process.

Step (2)

In this step, the roll-shaped laminate is unwound and cut into a predetermined shape to continuously produce a plurality of abrasive discs.

The unwinding may be carried out at a speed of 5 to 35 m/min, but it is not limited thereto.

The cutting is not particularly limited as long as it is a method capable of cutting a large-sized, roll-shaped laminate into a shape of an abrasive disk. For example, a laser cutter may be used.

The predetermined shape is not particularly limited as long as it is a size and shape of an abrasive disk. For example, the predetermined shape may be such various shapes as a circular shape, a donut shape, and a spherical shape.

As described above, the abrasive disk produced by cutting has a planar shape. For the production of an abrasive disk having a curved shape as a whole, the process for producing an abrasive disk may further comprise shaping it.

The shaping is not particularly limited as long as it is a conventional method used to make a planar abrasive disk into a curved shape. For example, a pressing hardening step may be carried out after the pressing step. Specifically, the shaping may comprise pressing under a pressure of 40 to 80 bar at 50 to 70° C.; and hardening for 5 to 8 hours while it is pressed under a pressure of 5 to 20 bar at 130 to 160° C. More specifically, the shaping may comprise pressing under a pressure of 45 to 70 bar or 45 to 60 bar at 55 to 65° C.; and hardening for 5 to 7 hours or 5.5 to 6.5 hours while it is pressed under a pressure of 5 to 15 bar or 8 to 12 bar at 140 to 160° C. or 140 to 150° C.

When the abrasive disk produced by the shaping as described above and having a curved shape as a whole is placed upside-down on the ground, the connecting line between the edge of the abrasive disk and the center of the inner concave surface may form an angle of 5 to 9 degrees with the ground surface.

Therefore, the production process of the present invention can continuously mass-produce an abrasive disk more economically than a conventional production process in which each constituent layer cut in a disk form is individually laminated and pressed to produce an abrasive disk.

EXAMPLE

Preparation Example 1: Preparation of a Surface-Treated Glass Fiber

A glass fiber fabric in the form of a roll (10) (supplied by Hyundai Fiber Co.; Ltd., brand name: G 313, weight: 140 g/m$^2$, thickness: 0.2 mm, E-glass) having a fiber thickness of G75 ½×G75 ½ (warp×weft) tex/yarn and a plain weave of 13×13 (warp×weft) count/inch was impregnated using a winder in a phenol resin KR-50E (supplied by Tae Yang Chemical Co., Ltd., viscosity (IV) at 25° C.: 1,000 cps, weight average molecular weight: 12,000 g/mole) as a thermosetting resin (80) in an amount of 138.0±1.0 g/m$^2$. It was then first dried at 95° C. for 5 minutes, second dried at 105° C. for 5 minutes, third dried at 1120° C. for 10 minutes, and fourth dried at 145° C. for 5 minutes to prepare a surface-treated glass fiber fabric (11) (see FIG. 4).

Preparation Example 2: Preparation of a Surface-Treated Hemp Fiber

A surface-treated hemp fabric (21) was prepared in the same manner as in Preparation Example 1, except that a hemp fabric (20) (supplied by anji qingyu jute textile mill, brand name: 7-12 oz burlap fabric, thickness: 1.25 mm, weight: 285 g/m$^2$, in the form of a roll and having a plain weave of 10×12 (warp×weft) counts/inch, jute) was used instead of the glass fiber fabric.

Example 1: Preparation of an Abrasive Disk in a Planar Shape

A coated abrasive in the form of a roll (30) (supplied by Sun Abrasive Co. Ltd., brand name: F359D P36, thickness: 1.35 mm) was sequentially laminated using a winder with the surface-treated hemp fabric (21) of Preparation Example 2, the surface-treated glass fiber fabric (11) of Preparation Example 1, and a vulcanized fiber (50) (supplied by QINGDAO TIANFENG PAPER, brand name: E-5/E-8, thickness: 0.50 mm, density: 1.25 g/cm$^3$, a wooden fiber). It was then pressed (200) at 145° C. and 10 bar, first dried (E) at 125° C. for 10 minutes, and second dried (D) at 145° C. for 15 minutes to prepare a laminate in the form of a roll (40) (see FIG. 5). Thereafter, while the laminate in the form of a roll (40) was unwound, it was cut with a laser cutter (300) into a size of 112 mm in outer diameter and 23 mm in inner diameter to produce an abrasive disk (41) (see FIG. 7).

Example 2

A coated abrasive in the form of a roll (30) (supplied by Sun Abrasive Co. Ltd., brand name: F359D P36) was coated using a winder with a vinyl acetate resin (60) (supplied by Korea Polymer Co., Ltd., brand name: HY-580, weight average molecular weight: 1,200 g/mole) as a thermoplastic resin in a thickness of 1.45 mm to form an adhesive layer. Laminated thereon was a vulcanized fiber (50) (supplied by QINGDAO TIANFENG PAPER, brand name: E-5/E-8, thickness: 0.50 tam, density: 1.25 g/cm$^3$, a wooden fiber). It was then pressed at 125° C. and 15 bar, first dried (E) at 125° C. for 15 minutes, and second dried (D) at 145° C. for 15 minutes to prepare a laminate in the form of a roll (70) (see FIG. 6). Thereafter, while the laminate in the form of a roll (70) was unwound, it was cut with a laser cutter (300) into a size of 112 mm in outer diameter and 23 mm in inner diameter to produce an abrasive disk (41) (see FIG. 7).

Example 3: Preparation of an Abrasive Disk in a Curved Shape

The abrasive disk (41) of Example 1 was pressed using a mold stand (400) (having an angle of 6 degrees formed by the connecting line between the edge of the abrasive disk and the center of the inner concave surface, when the abrasive disk is placed upside-down on the ground) at 60° C. and 50 bar. It was then hardened for 6 hours while it was pressed by a pressing shaper (500) at 145° C. and 10 bar to produce an abrasive disk (42) having a curved shape (see FIG. 7).

Examples 4 to 6

Abrasive disks were each produced in the same manner as in Example 1, except that the vulcanized fibers having a thickness shown in Table 1 below were used.

TABLE 1

| | Thickness of a vulcanized fiber (mm) |
|---|---|
| Ex. 1 | 0.50 |
| Ex. 4 | 0.55 |
| Ex. 5 | 0.65 |
| Ex. 6 | 0.75 |

Comparative Example 1

An abrasive disk was produced in the same manner as in Example 1, except that no vulcanized fiber was laminated.

Comparative Example 2

An abrasive disk having a planar shape was produced in the same manner as in Example 1, except that a vulcanized fiber (supplied by QINGDAO TIANFENG PAPER, brand name: A-6, thickness: 0.65 mm, density: 839 g/cm$^3$) made of a cotton fiber, instead of a wooden fiber, was used.

Test Example: Evaluation of Physical Properties

The abrasive disks prepared in Examples 1 to 6 and Comparative Examples 1 and 2 were evaluated as follows. The results are shown in Table 2.

(1) Tensile Strength (N/Cm$^2$)

While a sample was tested at a rate of 50 mm/min at 25° C. using a universal testing machine (UTM), the maximum strength value immediately before fracture was measured.

(2) Flexibility (m/N)

The abrasive disk was evaluated for the flexibility using a flexibility tester (manufacturer: BENDING RESIST TESTER TMI BUCHEL, B.V, model name: K416).

(3) Durability/Elasticity (Angle, Degree)

The abrasive disk was evaluated for the durability using an impact tester (manufacturer: Sukbo Scientific, Model: D-5000N) at an impact of 5,000 MPa. Specifically, the smaller the angle of rupture upon the impact, the better the durability and elasticity.

TABLE 2

| | Ex. 1 | Ex. 2 | Ex. 3 | Ex. 4 | Ex. 5 | Ex. 6 | C. Ex. 1 | C. Ex. 2 |
|---|---|---|---|---|---|---|---|---|
| Tensile strength (N/cm$^2$) | 11.20 | 8.30 | 15.80 | 8.90 | 9.50 | 10.25 | 6.25 | 5.30 |
| Flexibility (m/N) | 98.0 | 52.5 | 77.0 | 49.0 | 55.0 | 62.5 | 120.0 | 88.0 |
| Durability (°) | 25.0 | 30.0 | 13.0 | 14.5 | 17.5 | 19.8 | 65.0 | 90.0 |

As shown in Table 2, the abrasive disks of Examples 1 to 6 were excellent in all of tensile strength, flexibility, and durability.

In contrast, the abrasive disk of Comparative Example 1, which comprised no vulcanized fiber layer, had low tensile strength, low flexibility, and weak durability. In addition, the abrasive disk of Comparative Example 2, which comprised a vulcanized fiber layer made of a cotton fiber, had low tensile strength and weak durability.

| Reference Numerals of the Drawings | |
|---|---|
| 10: glass fiber fabric | 11: surface-treated glass fiber fabric |
| 20: hemp fabric | 21: surface-treated hemp fabric |
| 30: coated abrasive | 50: vulcanized fiber |
| 40, 70: laminate in the form of a roll. | |
| 41: cut laminate (abrasive disk) | |
| 42: shaped abrasive disk (angled abrasive disk) | |
| 60: adhesive (thermoplastic resin) | |
| 80: adhesive (thermosetting resin) | |
| 90: interposed layer | |
| 100: drier | 200: thermal pressing roller |
| 300: cutter (laser cutter) | 400: shaper (pressing step) |
| 500: pressing shaper | |
| A: dried at 95° C. | B: dried at 105° C. |
| C: dried at 120° C. | D: dried at 145° C. |
| E: dried at 125° C. | |

The invention claimed is:

1. An abrasive disk, which comprises:

a coated abrasive;

an interposed layer comprising one or more selected from the group consisting of a hemp fabric layer, a glass fiber fabric layer, and an adhesive layer; and a vulcanized fiber layer, wherein the vulcanized fiber layer comprises a fiber derived from a wooden fiber and has a tensile strength of 2,000 to 5,000 N/cm$^2$ at 25° C.

2. The abrasive disk of claim 1, wherein the vulcanized fiber layer has an average thickness of 0.085 to 1.25 mm and a weight per unit area of 100 to 2,000 g/m$^2$.

3. The abrasive disk of claim 1, wherein the interposed layer comprises the glass fiber layer and the hemp fabric layer, wherein the glass fiber fabric layer and the hemp fabric layer are each impregnated with a thermosetting resin or a thermoplastic resin.

4. The abrasive disk of claim 3, wherein the thermosetting resin is one or more selected from the group consisting of a phenol resin, a polyester resin, an epoxy resin, a urea resin, a melamine resin, a diallyl phthalate prepolymer resin, a furan resin, an alkyd resin, an unsaturated polyester resin, a silicone resin, and a polyurethane resin.

5. The abrasive disk of claim 1, wherein the glass fiber fabric layer comprises one selected from the group consisting of E-GLASS, C-GLASS, AR-GLASS, S-GLASS, and D-GLASS.

6. The abrasive disk of claim 1, wherein the glass fiber fabric has a fiber thickness of G75 ¼ to H50 ⅔×G75 ¼ to H50 ¾ (warp×weft) tex/yarn, a weight per unit area of 10 to 500 g/m$^2$, a texture of 3 to 20×3 to 20 (warp×weft) counts/inch, and a thickness of 0.1 to 0.8 mm.

7. The abrasive disk of claim 1, wherein the hemp fabric layer has a weight per unit area of 105 to 485 g/m$^2$, a texture of 5×6 to 13×14 (warp×weft) counts/inch, and a thickness of 0.5 to 3.5 mm.

8. The abrasive disk of claim 1, wherein the hemp fabric layer comprises one or more selected from the group consisting of flax, ramie, ramie cloth, hemp, hemp cloth, jute, manila hemp, sisal hemp, New Zealand hemp, aloe fiber, and coconut fiber.

9. The abrasive disk of claim 1, wherein the adhesive layer comprises a thermosetting resin or a thermoplastic resin having a weight average molecular weight of 1,000 to 50,000 g/mole.

10. The abrasive disk of claim 9, wherein the thermoplastic resin comprises one or more selected from the group consisting of a vinyl chloride resin, a vinylidene chloride resin, a vinyl acetate resin, polyvinyl alcohol, polyvinyl acetal, polystyrene, a styrene-acrylonitrile resin (AS resin), an acrylonitrile butadiene styrene resin (ABS resin), a methacrylic resin, polyethylene, polypropylene, a fluororesin, polyamide, polyacetal, polycarbonate, polyvinylene oxide, polysulfone, celluloid, a cellulose acetate resin, a vinylene acetate resin, and a saturated polyester.

11. The abrasive disk of claim 1, wherein the interposed layer comprises the glass fiber fabric layer; and wherein the vulcanized fiber layer, the glass fiber fabric layer, and the coated abrasive are sequentially laminated.

12. The abrasive disk of claim 1, wherein the interposed layer comprises the glass fiber fabric layer and the hemp fabric layer; and wherein the vulcanized fiber layer, the glass fiber fabric layer, the hemp fabric layer, and the coated abrasive are sequentially laminated.

13. The abrasive disk of claim 1, wherein the interposed layer comprises the adhesive layer; and wherein the vulcanized fiber layer, the adhesive layer, and the coated abrasive are sequentially laminated.

14. A process for producing an abrasive disk, which comprises:

(1) laminating a coated abrasive, an interposed material, and a vulcanized fiber, and then pressing, drying, and winding the laminate to prepare a roll-shaped laminate; and (2) unwinding the roll-shaped laminate and cutting it into a predetermined shape to continuously produce a plurality of abrasive discs, wherein the interposed material comprises at least one selected from the group consisting of a hemp fabric, a glass fiber fabric, and an adhesive, and the lamination, pressing, drying, and winding in the above step (1) are carried out in a continuous process to produce the abrasive disk, wherein the abrasive disk comprises the coated abrasive, an interposed layer of the interposed material, and a vulcanized fiber layer; and wherein the vulcanized fiber layer comprises a fiber derived from a wooden fiber and has a tensile strength of 2,000 to 5,000 N/cm$^2$ at 25° C.

15. The process for producing an abrasive disk of claim 14, wherein, in the above step (1), the pressing is carried out under a pressure of 10 to 100 bar at 80 to 165° C.; and the drying is carried out at 120 to 150° C.

16. The process for producing an abrasive disk of claim 14, wherein the interposed layer comprises a hemp fabric layer and a glass fiber fabric layer, and wherein the hemp fabric and the glass fiber fabric layer are each impregnated with a thermosetting resin and then dried at 90 to 165° C.

17. The process for producing an abrasive disk of claim 14, wherein, in the above step (1), the coated abrasive, the hemp fabric, the glass fiber fabric, and the vulcanized fiber are sequentially laminated, and the laminate is then pressed under a pressure of 10 to 50 bar at 90 to 160° C. and dried at 120 to 150° C.

18. The process for producing an abrasive disk of claim 14, wherein, in the above step (1), the adhesive is applied on the coated abrasive, the vulcanized fiber is laminated thereon, and the laminate is then pressed under a pressure of 15 to 30 bar at 125 to 145° C. and dried at 120 to 150° C.

* * * * *